US007182425B2

(12) United States Patent
Uwagaki et al.

(10) Patent No.: US 7,182,425 B2
(45) Date of Patent: Feb. 27, 2007

(54) PRINTER

(75) Inventors: Hideo Uwagaki, Kyoto (JP); Ryoichi Kawai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/411,097

(22) Filed: Apr. 11, 2003

(65) Prior Publication Data

US 2003/0193541 A1 Oct. 16, 2003

(30) Foreign Application Priority Data

Apr. 12, 2002 (JP) ..... P2002-111090
Apr. 8, 2003 (JP) ..... P2003-103571

(51) Int. Cl.
*B41J 2/165* (2006.01)

(52) U.S. Cl. ..... 347/29; 347/30; 347/31; 347/32; 347/33

(58) Field of Classification Search ..... 347/22–36
See application file for complete search history.

(56) References Cited

U.S. PATENT DOCUMENTS 5,559,539 A 9/1996 Vo et al.
6,123,407 A * 9/2000 Muraki ..... 347/24
6,132,027 A 10/2000 Suzuki et al.
6,139,128 A * 10/2000 Magirl et al. ..... 347/22
6,398,338 B1 * 6/2002 Berg et al. ..... 347/32

FOREIGN PATENT DOCUMENTS

| | | |
|---|---|---|
| EP | 0922583 A2 | 6/1999 |
| JP | 7-125223 | 5/1995 |
| JP | 2000-233517 | 8/2000 |
| TW | 451813 | 8/2001 |

OTHER PUBLICATIONS

Berg, Richard H., Xerox Disclosure Journal, "Printhead Capping Via Vertical Motion of a Spring Rod," vol. 25, No. 2, p. 67, Mar./Apr. 2001 XP-001058575.

* cited by examiner

*Primary Examiner*—Lamson Nguyen
*Assistant Examiner*—Ly T. Tran
(74) *Attorney, Agent, or Firm*—Birch, Stewart, Kolasch & Birch, LLP

(57) ABSTRACT

A printer apparatus in which its apparatus main body's width dimension can be minimized, by achieving compact housing of a maintenance station for performing maintenance operations with effective use of the space existing at both ends of a printing region. There are maintenance stations separately arranged as left- and right-hand portions at both ends outside the printing region. The maintenance station provides: a capping mode for capping a nozzle of the printing head; a wiping mode for wiping the nozzle of the printing head; and an ink spitting mode for preventing clogging of the nozzle of the printing head, and also the maintenance station includes a waste ink collecting bath for collecting ink discharged during the ink spitting mode.

13 Claims, 8 Drawing Sheets

PRINTER

BACKGROUND OF THE INVENTION

This nonprovisional application claims priority under 35 U.S.C. § 119(a) on Patent Application No(s). 2002-111090 and 2003-103571 filed in JAPAN on Apr. 12, 2002 and Apr, 8, 2003, which is (are) herein incorporated by reference.

1. Field of the Invention

The present invention relates to an arrangement of a maintenance mechanism designed for an ink-jet type printer that produces a printed record by applying ink droplets to a recording medium.

2. Description of the Related Art

In general, an ink-jet printer has the following three operational modes: (1) a capping operation mode; (2) a cleaning operation mode; and (3) a printing operation mode. The capping operation mode serves to prevent drying of ink in a printing head, and to protect its nozzle. The cleaning operation mode is-composed of a wiping operation for wiping and cleaning the nozzle to remove residual ink and foreign substances deposited onto the nozzle surface of the printing head, and a spitting operation for discharging ink. The printing operation mode serves to perform an ordinary printing operation.

Of the three operational modes, the former two are related to maintenance required for operating the printer properly. Commonly, a maintenance station incorporating a maintenance mechanism for achieving proper maintenance is arranged in a position outside the printing region so as not to disturb the printing operation. For example, Japanese Unexamined Patent Publication JP-A 2000-233517 (2000) discloses one example of a maintenance station as shown in FIGS. 9, 10, and 11. In this example, the maintenance station is arranged in a left-hand position outside the printing region.

With reference to these drawings, the above-mentioned operational modes will be described. At first, in FIG. 9, a maintenance station 36 is positioned at the left end defined as one end of the main scanning direction in synchronism with a carriage 32. The carriage 32 is guided by a carriage shaft 35 which is horizontally suspended by a main frame 31. A side wall A of a slide case abuts against the inner side of the left-hand side wall defined as one end side wall of the main scanning direction of the main frame 31. In this positional arrangement, the maintenance station 36 is held at the highest position (top dead center) by the action of a sliding projection C which is loosely and slidably fitted in a slanted cam groove B formed in a base portion 39 of the printer. Mounted in the maintenance station 36 are a cap 37*a* and a cap 37*b* for hermetically sealing nozzle portions (their positions are indicated by symbols ▼) of two printing heads 33 and 34.

On the other hand, two wipers 38*a* and 38*b* mounted in the maintenance station 36 are located on the right-hand sides defined as other ends of the main scanning direction of the printing heads 33 and 34, respectively. Since these wipers 38*a* and 38*b* are kept out of contact with the nozzle surface, the wiping operation is not effected in this state. In the ink-jet printer, this state is normally regarded as a so-called standby state for awaiting printing instructions, that is, the power is turned off, or no printing operation is being carried out.

Next, in FIG. 10, the maintenance station 36 is moved slightly toward the lower right defined as the one lower end along the main scanning direction in accompaniment with the carriage 32 which moves rightward, namely, the other end along the main scanning direction. The sliding projection C is locked, in the midpoint of the cam groove B, by a non-illustrated locking mechanism. In this state, the maintenance station 36 is moved slightly downward away from the printing heads 33 and 34, and the two caps 37*a* and 37*b* are kept away from the nozzle portions of the two printing heads 33 and 34, respectively. However, the interval between the maintenance station 36 and the printing head 33 and 34 is set to be shorter than the height of the wiper 38*a* and 38*b*.

Therefore, the front end of the wiper 38*a*, 38*b* exceeds the height of the nozzle surface of the printing head 33 and 34 in the free state. Since the carriage 32 carrying the two printing heads 33 and 34 is being moved toward the printing region, during this time, the wipers 38*a* and 38*b* are flexibly brought into sliding contact with the nozzle surfaces of the moving printing heads 33 and 34, thereby achieving the wiping operation.

Moreover, in the state shown in FIG. 10, in addition to the wiping operation, the operation for discharging ink (spitting operation) is carried out to remove residual ink deposited onto the nozzle surfaces of the printing heads 33 and 34. That is, as shown in the figure, while the nozzle portion of the printing head 33 and 34 is located in the region between the wiper 38*a* and 38*b* and the cap 37*a* and 37*b*, ink is discharged by driving the printing head 33 and 34. The ink thus discharged is stored, as waste ink, in a non-illustrated discharge pot (waste ink collecting bath) arranged on the bottom surface of the maintenance station 36.

In FIG. 11, the sliding projection C is unlocked, and moved toward the right end defined as the other end along the main scanning direction of the cam groove B in accompaniment with the carriage 32 which moves rightward, namely, to the other end along the main scanning direction. The maintenance station 36 is held at the lowest position (bottom dead center), and moved downward further away from the printing heads 33 and 34, and the two caps 37*a* and 37*b* are entirely kept away from the nozzle portions of the printing heads 33 and 34, respectively. The front ends of the wipers 38*a* and 38*b* are also moved away from the nozzle surfaces of the printing heads 33 and 34, respectively. The carriage 32 is moved reciprocally along the main scanning direction. Thereupon, the printer is brought into the printing operation mode, whereby printing is performed on a recording medium in accordance with printing signals.

However, the above stated conventional example has the following disadvantages. Integrating the maintenance station 36 in one-side position (left-hand side position defined as the one end along the main scanning direction) outside the printing region gives rise to a problem of the structure being complicated, as well as a problem of the structure occupying an unduly large area. Resultantly, the apparatus main body cannot be made compact as a whole. Meanwhile, an attempt to downsize the maintenance station 36 makes it impossible to secure a sufficient volumetric capacity in the waste ink collecting bath.

Moreover, in terms of structural design, the caps 37*a* and 37*b* and the wipers 38*a* and 38*b* cannot be moved upwardly and downwardly without moving the maintenance station 36 slidingly to both main scanning directions, namely, from side to side. Thus, extra space is required in the direction of the width of the apparatus main body (indicated by reference symbol L2 in FIG. 11). Further, being built as a 2-pen type ink-jet printer, the printing head 33 and 34; the cap 37*a* and 37*b*; the wiper 38*a* and 38*b*; and the waste ink collecting bath each need to be arranged pairwise. Integrating such a large number of components in one position results in the maintenance mechanism as a whole being complicated, and the size of the apparatus being increased. This makes miniaturization difficult.

SUMMARY OF THE INVENTION

The invention has been devised in view of the above-described problems with the conventional art, and accordingly its object is to provide a printer which succeeds in reduction in the width dimension of its apparatus main body, by achieving compact housing of a maintenance station for performing maintenance operations with effective use of the space existing on each end of a printing region.

The structural features of the invention, which have been devised to solve the above stated problems, will be set forth hereunder.

The invention provides a printer in which printing is carried out by reciprocating a carriage carrying two printing heads along a main scanning direction, comprising:

maintenance mechanisms each including a wiper for wiping a nozzle of the printing head in a part of a range of reciprocation of the carriage, wherein the wipers are respectively arranged at both ends of the range of reciprocation of the carriage, the ends being outside a printing region.

According to the invention, the wipers for wiping the nozzle of the printing head are respectively arranged at the left- and right-hand ends along the main scanning direction outside the printing region. With this construction, it is possible to use effectively the space existing at each end of the printing region, which is inevitably created in a printer in which printing is carried out by two printing heads. Thus, the flexibility in the arrangement of each maintenance mechanism is significantly enhanced.

Hence, a sufficient volumetric capacity can be secured in the waste ink collecting bath. Moreover, the widthwise size of the apparatus main body can be reduced to a minimum without imposing strict limitations on the other maintenance mechanisms.

In the invention, it is preferable that, the maintenance mechanisms are so operated as to function only in a direction perpendicular to the main scanning direction and a sub scanning direction.

According to the invention, the maintenance mechanism is so operated as to function only in a direction perpendicular to the main and sub scanning directions. That is, when the printer is arranged horizontally, the maintenance mechanism is so operated as to function only in a vertical direction. This eliminates the need to secure space for widthwise movement, thereby achieving reduction in the widthwise size of the apparatus main body.

In the invention, it is preferable that, the maintenance mechanisms, which are respectively arranged at the both ends of the range of reciprocation of the carriage, are driven by a cam attached to a single cam shaft which is rotationally driven.

According to the invention, both of the maintenance mechanisms are driven by a single cam shaft. In this case, only one driving source is required, and the number of constituent components can accordingly be reduced. Moreover, the construction can be controlled with ease, and resultantly the manufacturing cost can be reduced.

In the invention, it is preferable that the maintenance mechanism comprises:

a cap for sealing the nozzle;

a first cam for acting to move the cap retractably and advanceably with respect to the printing head;

a second cam for acting to move the wiper retractably and advanceably with respect to the printing head; and a single cam shaft to which the first and second cams are attached, and wherein switching among the following three modes is made by rotating the cam shaft one turn:

a capping mode for sealing the nozzle by the cap;

a wiping mode for wiping the nozzle by the wiper; and an ordinary printing mode.

According to the invention, by rotating the cam shaft one turn, the cams are activated, and thereby the cap and the wiper are each shifted selectively to three different level positions with respect to the printing head: the level for performing the capping operation (highest); the level for performing the wiping operation (middle); and the level for performing the printing operation (lowest).

In the invention, it is preferable that the maintenance mechanism comprises:

a cap for sealing the nozzle;

a cap holding member for holding the cap;

a cam;

a cam shaft to which the cam is attached; and a pair of first urging means for urging the cap holding member into abutment with the cam, the pair of first urging means being arranged at places on one of the diagonal lines of the cap holding member as equally-spaced from the cam shaft.

According to the invention, the pair of first urging means are arranged at places on one of the diagonal lines of the cap holding member as equally-spaced from the cam shaft. With this arrangement, the cap holding member can be urged toward the cam in a well-balanced manner and thus the supporting status can be maintained with stability. Moreover, since the structure is simple, the manufacturing cost can be reduced.

In the invention, it is preferable that the maintenance mechanism comprises:

a wiper holding member for holding the wiper;

a cam;

a cam shaft to which the cam is attached; and a pair of second urging means for urging the wiper holding member into abutment with the cam, the pair of second urging means being arranged at places on opposite sides of the cam shaft as equally-spaced from an axis of the wiper holding member orthogonal to the cam shaft.

According to the invention, the pair of second urging means are arranged at places on opposite sides of the cam shaft as equally-spaced from an axis of the wiper holding member orthogonal to the cam shaft. With this arrangement, the wiper holding member can be urged toward the cam in a well-balanced manner and thus the supporting status can be maintained with stability. Moreover, since the structure is simple, the manufacturing cost can be reduced.

In the invention, it is preferable that the first and second urging means are constituted by a tensile spring.

According to the invention, by employing the tensile spring as the first and second urging means, the urging mechanism can be constructed at lower cost.

In the invention, it is preferable that the maintenance mechanism comprises a cap for sealing the nozzle, and a waste ink collecting bath for collecting ink discharged from the nozzle, and wherein in one end of the range of reciprocation of the carriage, the cap, the wiper and the cap are provided along the main scanning direction in this order, whereas in the other end of the range of reciprocation of the carriage, the waste ink collecting bath, the wiper and the waste ink collecting bath are provided along the main scanning direction in this order.

According to the invention, in one end of the range of reciprocation of the carriage, the cap, the wiper and the cap are provided along the main scanning direction in this order, whereas in the other end of the range of reciprocation of the carriage, the waste ink collecting bath, the wiper and the waste ink collecting bath are provided along the main scanning direction in this order. With this arrangement, it is possible to reduce the widthwise size of an apparatus main body to a minimum in a state where sealing the nozzle by the cap can be concurrently performed with respect to the two printing heads and collecting ink discharged from the nozzle can be concurrently performed with respect to the two printing heads.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PRESENT INVENTION

Figure 1:
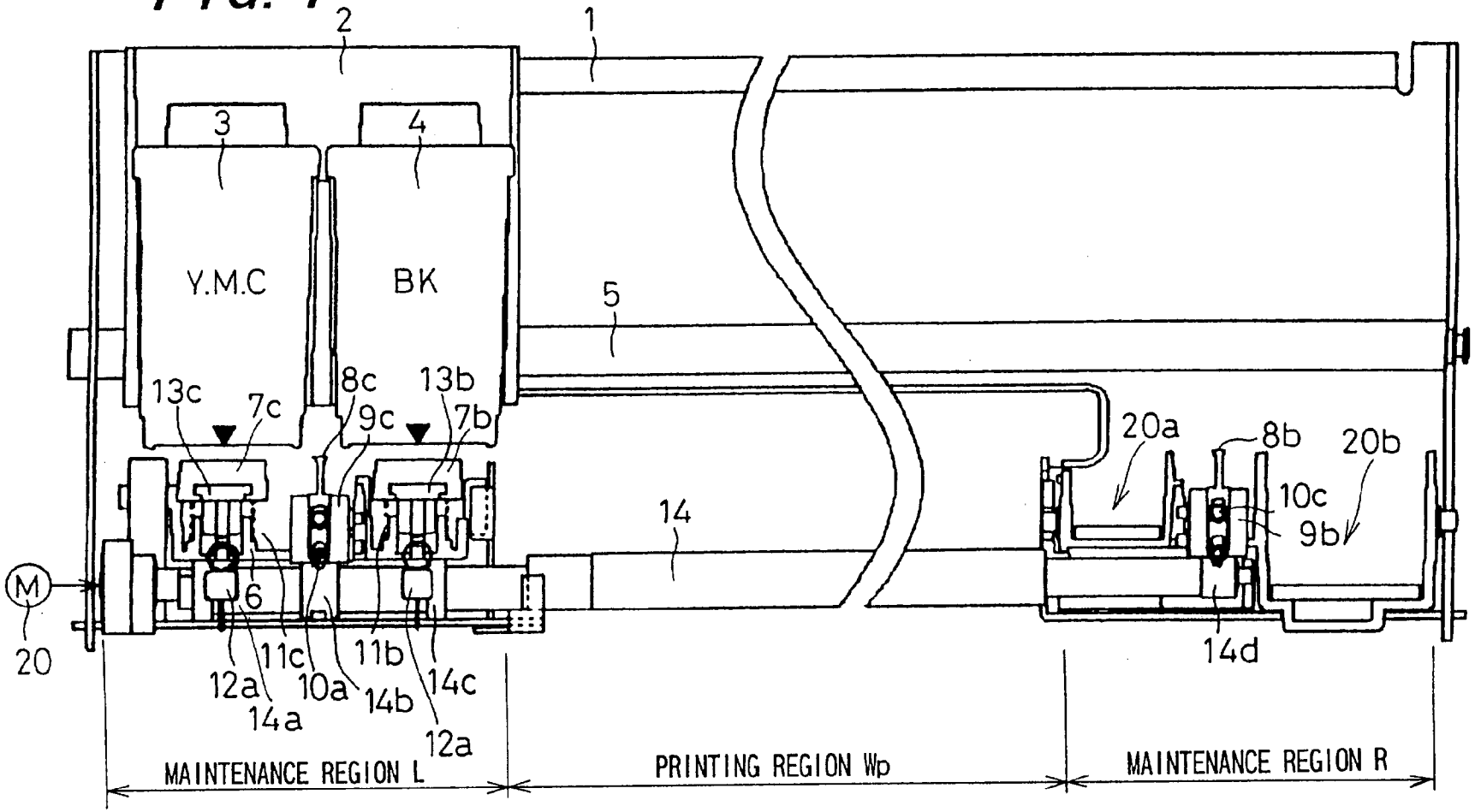
FIG. 1 is an explanatory block diagram showing a printer according to one embodiment of the invention.

Now referring to the drawings, embodiments of the invention are described below.

Hereinafter, a detailed description will be given as to the printer according to the embodiment of the invention, with reference to the accompanying drawings.

FIG. 1 is a front view of the printer. The printer is built as a 2-pen type serial printer and it has two printing heads 3 and 4, of which the printing head 3 serves to represent three primary colors for color recording: yellow (Y); magenta (M); and cyan (C), and the other printing head 4 serves to represent black color (Bk). These two printing heads 3 and 4 are detachably attached to a carriage 2 which is guided by a carriage shaft 5. The carriage shaft 5 is horizontally suspended by a main frame 1. By moving the carriage 2 from left to right or vise versa, as viewed in FIG. 1, the printing heads 3 and 4 are moved reciprocally along the main scanning direction with respect to a recording medium (not shown). The recording medium is moved from the back side to the front side, as viewed in the figure, by non-illustrated recording sheet conveying means, so as to be conveyed along the sub scanning direction. As a result, a printed record is two-dimensionally produced onto the recording medium.

Particularly, in this embodiment, the maintenance stations are respectively provided at left- and right-hand portions defined as both ends along the main scanning direction, so that two maintenance regions L and R are arranged outwardly on both sides along the main scanning direction of a printing region Wp where a printed record is produced. Outwardly arranged on the left-hand side defined as the one end along the main scanning direction of the printing region Wp is the maintenance region L in which two caps 7*b* and 7*c* are disposed for hermetically sealing the printing heads 3 and 4, and a single wiper 8*c* is disposed for wiping the nozzle of the color-printing head 3 (its position is indicated by symbol ▼). Moreover, to move the caps 7*b* and 7*c* and the wiper 8*c* upward and downward, which are directions perpendicular to the main and sub scanning directions, cams 14*c*, 14*a*, and 14*b* are correspondingly attached to a cam shaft 14.

On the other hand, arranged on the right-hand side defined as the other side along the main scanning direction of the printing region Wp is the maintenance region R in which a wiper 8*b* is disposed for wiping the nozzle surface of the black-printing head 4, and discharge pots (waste ink collecting baths) 20*a* and 20*b* are disposed for collecting ink discharged during the ink-discharging operation (ink-spitting operation) to remove residual ink. Moreover, to move the wiper 8*b* upward and downward, which are directions perpendicular to the main and sub scanning directions, a cam 14*d* is attached to the cam shaft 14.

More specifically, in the left-hand maintenance region L, the caps 7*b* and 7*c* are attached to cap holding members (cap holders) 13*b* and 13*c*, respectively, in such a way as to be constantly urged upward by compression coil springs 11*b* and 11*c*. The cap holding members 13*b* and 13*c* are attached to a maintenance platform 6 so as to be movable upward and downward.

The maintenance platform 6 is guided by a guide boss and a guide rail so as to be moveable upward and downward. The guide boss is formed upstandingly in the main frame 1, and the guide rail is formed by bending part of the main frame 1. Between the maintenance platform 6 and the main frame 1 is stretched a pair of first urging means (tensile coiled spring) 12*a* and 12*b*. The maintenance platform 6 is urged downward, as viewed in FIG. 1, by the paired urging means 12*a* and 12*b*, whereby the cap holding member 13*b* and 13*c* is constantly kept, at its lower part, in abutment with first cams 14*a* and 14*c* under the resultant urging force.

The pair of first urging means 12*a* and 12*b* are arranged at places on one of the diagonal lines of the cap holding member 13*b* and 13*c* as equally-spaced from the cam shaft 14.

Moreover, one of the wipers 8*c* is fixed to a wiper holding member (wiper holder) 9*c*. The wiper holding member 9*c* is guidedly retained so as to be movable upward and downward by a guide member upstandingly formed in the maintenance platform 6. Between the wiper holding member 9*c* and the maintenance platform 6 is stretched a pair of second urging means (tensile coiled spring) 10*a* and 10*b*. The wiper holding member 9*c* is urged downward, as viewed in FIG. 1, by the paired urging means 10, whereby its lower part is constantly kept in abutment with a second cam 14*b* under the resultant urging force.

The pair of second urging means 10*a* and 10*b* are arranged at places on opposite sides of the cam shaft 14 as equally-spaced from an axis of the wiper holding member 9*c* orthogonal to the cam shaft 14.

On the other hand, in the right-hand maintenance region R, the other wiper 8*b* is fixed to a wiper holding member (wiper holder) 9*b*. The wiper holding member 9*b* is guidedly retained, so as to be movable upward and downward, by a guide member which is upstandingly formed in the other maintenance platform fixedly formed on the right-hand side, as viewed in FIG. 1, of the main frame 1. Between the wiper holding member 9*b* and the maintenance platform is stretched a pair of second urging means (tensile coiled spring) 10*c*. With the urging force exerted by the paired urging means 10*c*, the wiper holding member 9*b* is constantly kept, at its lower part, in abutment with a second cam 14*d*.

The pair of second urging means 10*c* are arranged at places on opposite sides of the cam shaft 14 as equallyspaced from an axis of the wiper holding member 9*b* orthogonal to the cam shaft 14.

Four pieces of the cams 14*a*, 14*b*, 14*c*, and 14*d* for effecting the operations of the cap 7*b*, 7*c* and the wiper 8*c* in the maintenance region L, and the wiper 8*b* in the maintenance region R, are all fixed to a single cam shaft 14. Here, the cams 14*a* and 14*c* are the first cam and the cams 14*b* and 14*d* are the second cam. With such a simple configuration, the three modes: the capping operation mode; the wiping operation mode; and the ordinary printing mode can be realized, by rotating the cam shaft 14 one turn, under simplified control.

Figure 2:
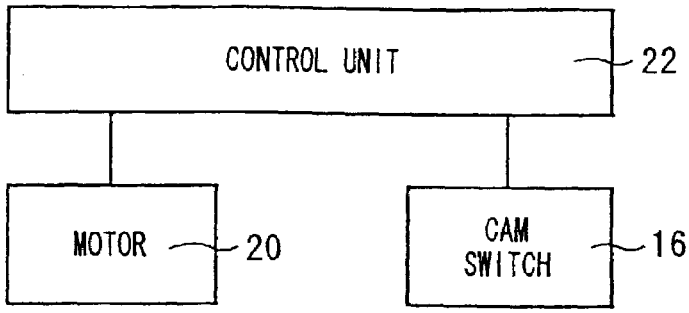
FIG. 2 is a block diagram schematically showing an electrical configuration of a maintenance station driving system of the printer.

FIG. 2 is a block diagram schematically showing an electrical configuration of the maintenance station driving system of the printer. The operations of the maintenance station are controlled by a control unit 22 so implemented as to include a central processing unit (CPU) and the like. The control unit 22 is electrically connected with a motor 20 for rotating the cam shaft 14, for example, implemented by a stepping motor, and is also electrically connected with a cam switch 16.

Figure 3:
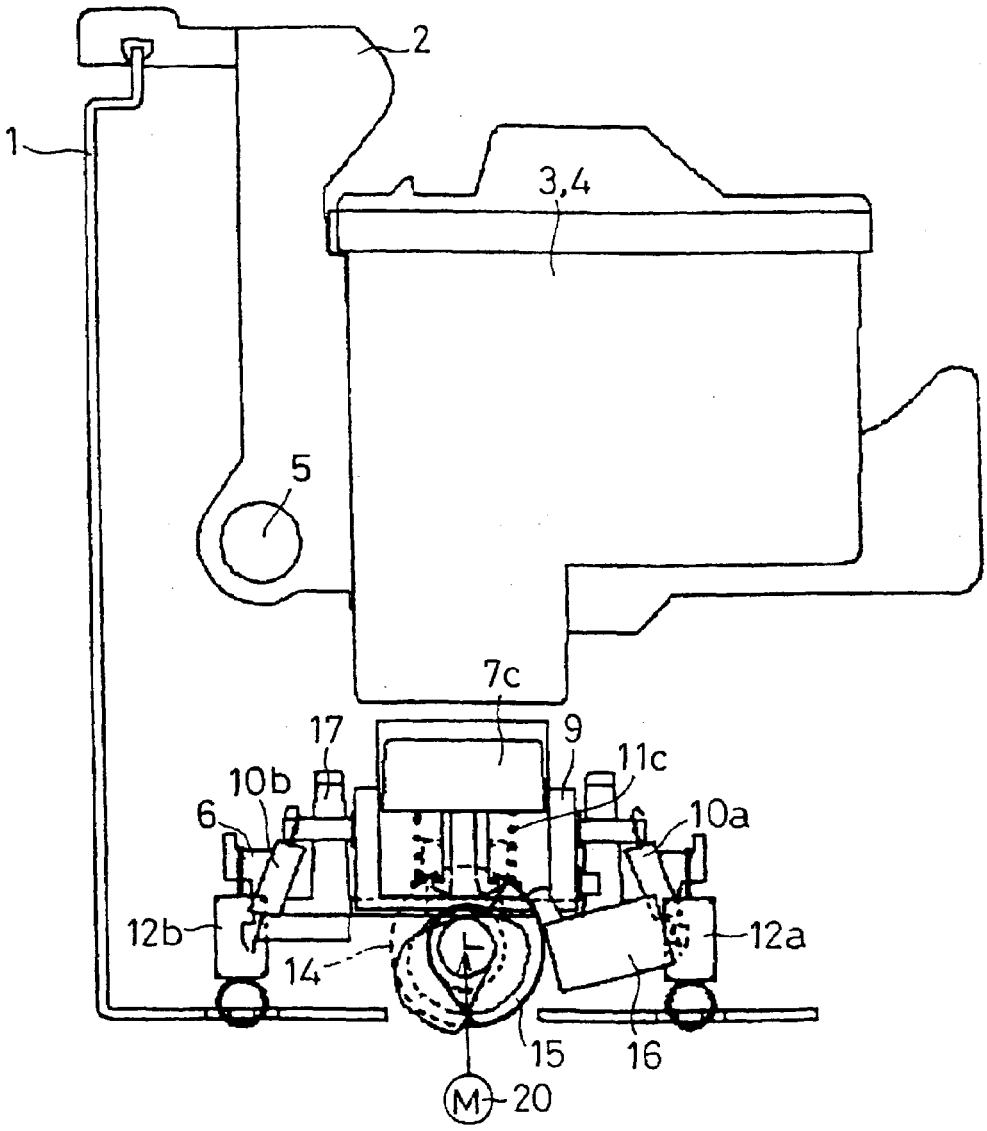
FIG. 3 is a block diagram of the printer being operated in a printing operation mode, as seen from the side.
Figure 4:
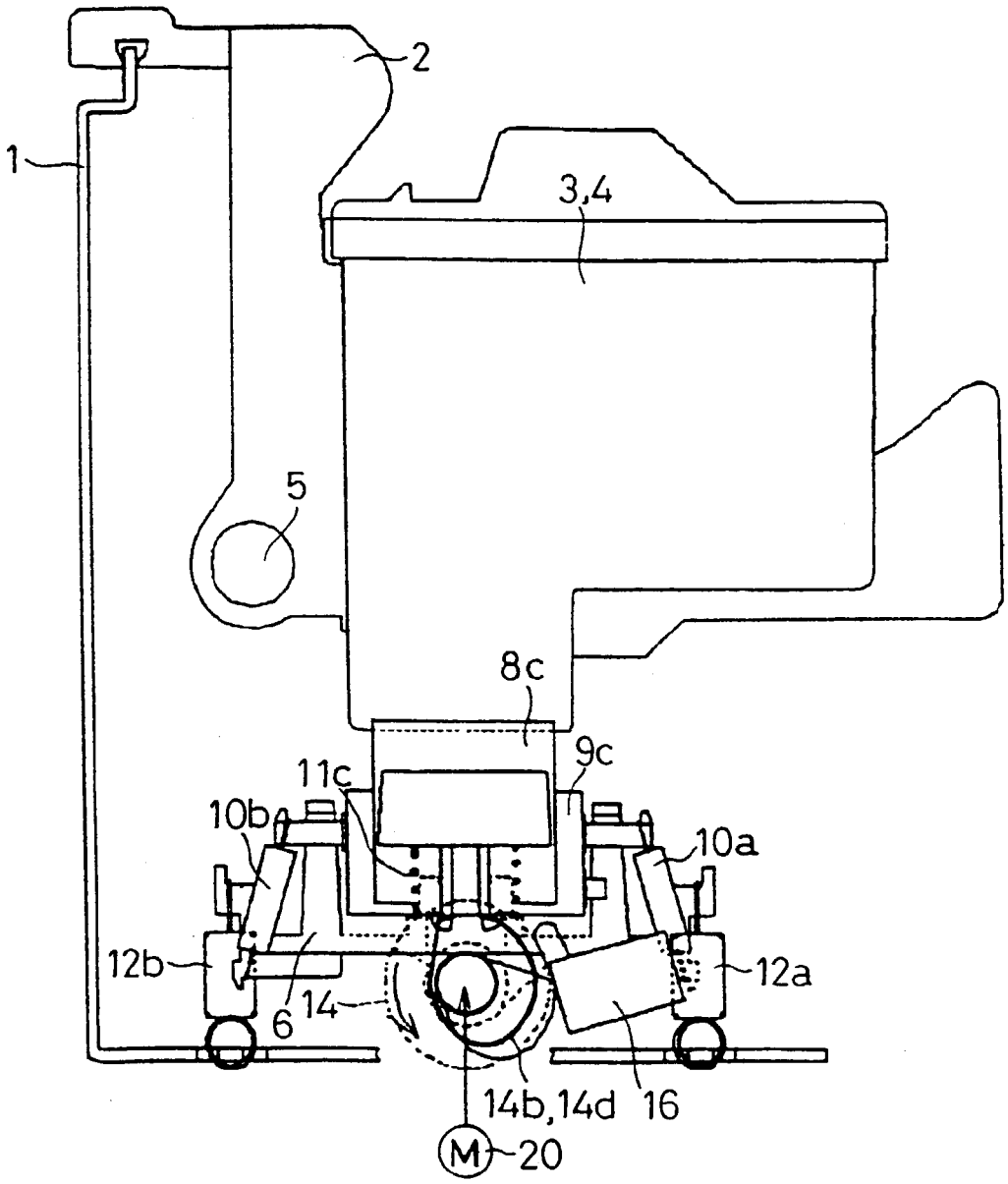
FIG. 4 is a is a block diagram of the printer being operated in a wiping operation mode, as seen from the side.
Figure 5:
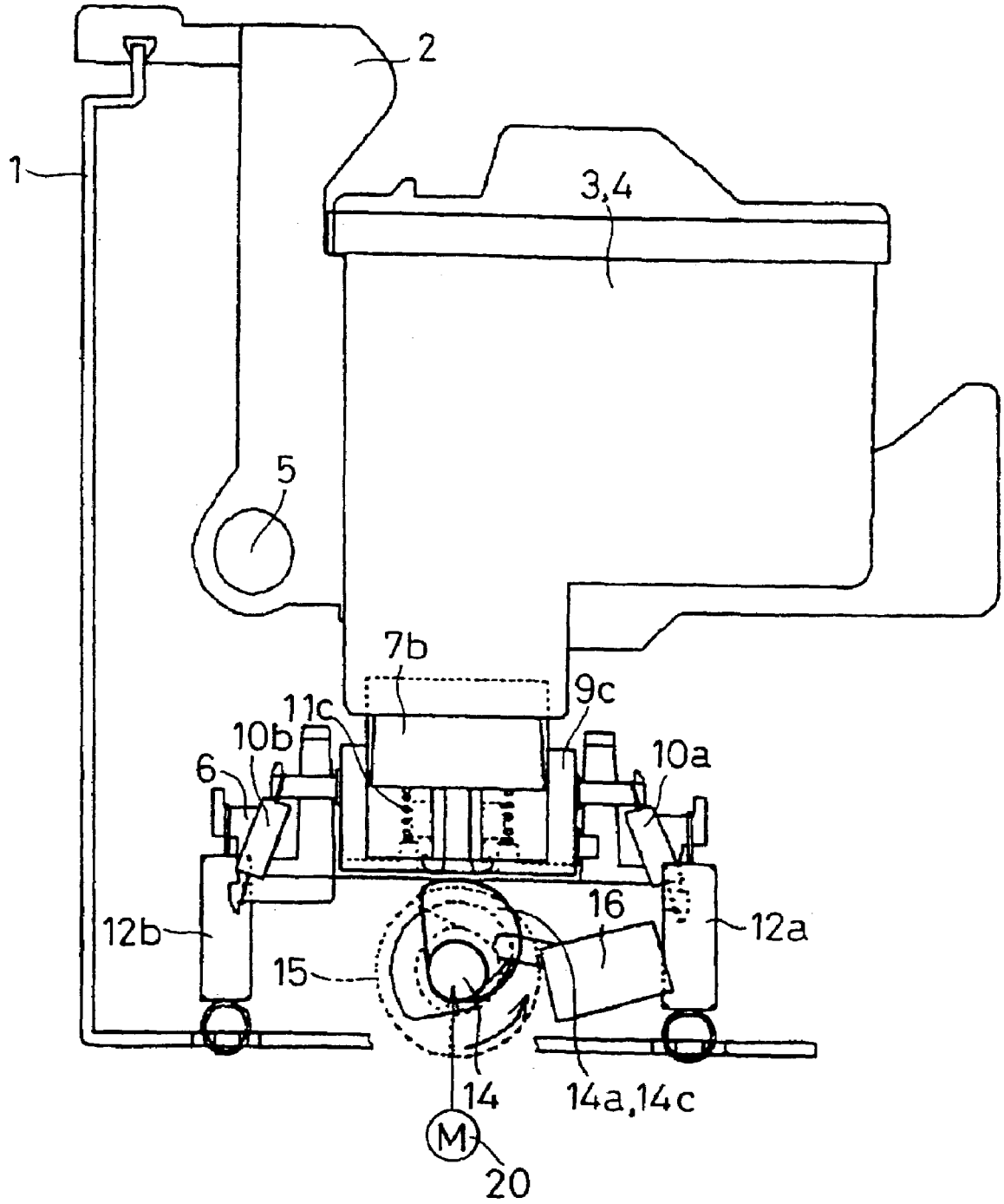
FIG. 5 is a is a block diagram of the printer being operated in a capping operation mode, as seen from the side.

FIGS. 3, 4, and 5 are block diagrams of the printer being operated in the printing operation mode, the wiping operation mode, and the capping operation mode, respectively, as seen from the side. Firstly, as for FIG. 3, none of the aforementioned cams is driven to function, and the cap 7*b* and 7*c* and the wiper 8*b* and 8*c* are each kept downward away from the printing head 3 and 4. That is, in this mode, no maintenance operation is being carried out and the printer is brought into a printable status (printing mode). At this time, the cap 7*b* and 7*c* and the wiper 8*b* and 8*c* are positioned in the printing mode.

Fixed to the cam shaft 14 is a cam gear 15 for performing position detection. By activating the cam switch 16, which is brought into abutment with the cam gear 15 under an urging force, the initial position of the cam shaft 14 can be detected. In response to the detection signal, a control command is outputted from the control unit 22 in accordance with the control program which has been configured and stored in advance. In response to the control command, the stepping motor 20 is controlled to be driven. As a result, the cams are activated in both of the maintenance regions L and R. thereby achieving switching among the modes.

As for FIG. 4, the condition of the printer changes from the state as shown in FIG. 3 to the wiping mode. By driving the stepping motor 20 in a predetermined number of steps, the cam shaft 14 is rotated at a predetermined angle in a direction indicated by an arrow. As a result, the wipers 8*c* and 8*b* are pushed upward so as to reach the acting position, i.e., the highest position (top dead center) by the second cam 14*b* belonging to the maintenance region L and the second cam 14*d* belonging to the maintenance region R, respectively. On the other hand, the first cam 14*a* and 14*c* is not driven to function, and the cap 7*b* and 7*c* is kept downward away from the printing head 3 and 4. At this time, the cap 7*b* and 7*c* and the wiper 8*b* and 8*c* are positioned in the wiping mode.

In this state, the lower part of the wiper holding member 9*c* and 9*b* for holding the wiper 8*c* and 8*b* is kept in abutment with the second cam 14*b* and 14*d*. Incidentally, the tensile coiled springs 10*a*, 10*b* and 10*c*, acting as the paired second urging means, are symmetrically arranged (equally spaced) with respect to the abutment area between the wiper holding member and the cam (or the shaft center of the cam shaft 14). By the action of the tensile coiled springs 10*a*, 10*b* and 10*c*, the wiper holding member 9*c* and 9*b* can be stably placed in abutment with the second cam 14*b* and 14*d* under an adequate urging force, and remain at rest with stability.

As for FIG. 5, the condition of the printer changes from the state as shown in FIG. 4 to the capping operation mode. By driving the stepping motor 20 further, the two first cams 14*a* and 14*c*, located in the maintenance region L, are rotated so as to reach their acting positions, so that the cap 7*c* and 7*b* is pushed upward so as to reach the acting position, i.e., the highest position (top dead center). As a result, the nozzle of the printing head 3 and 4 is hermetically sealed. On the other hand, the second cam 14*b* and 14*d* is not driven to function, and the wiper 8*b* and 8*c* is kept downward away from the printing head 3 and 4. At this time, the cap 7*b* and 7*c* and the wiper 8*b* and 8*c* are positioned in the wiping mode.

In this state, the cap holding member 13*c* and 13*b*, which holds the cap 7*c* and 7*b* via the compression coil spring 11 under an urging force, is kept, at its lower part, in abutment with the cam 14*a* and 14*c*. Incidentally, the tensile coiled springs 12*a* and 12*b*, acting as the paired first urging means, are symmetrically arranged (equally spaced) with respect to the abutment area between the cap holding member and the cam (or the shaft center of the cam shaft 14). By the action of the tensile coiled springs 12*a* and 12*b*, the cap holding member 13*c* and 13*b* can be stably placed in abutment with the cam 14*a* and 14*c* under an adequate urging force, and remain at rest with stability. Note that, in this embodiment, a tensile coiled spring is employed as the first and second urging means 10*a*, 10*b*, 10*c*, 12*a* and 12*b*. However, the invention is not limited thereto, and thus the first and second urging means can understandably be composed of a compression spring of different type, a plate spring, a rubber, or any other materials instead.

As described heretofore, in this embodiment, the maintenance mechanism of the 2-pen type ink-jet printer is so constructed that the capping and wiping operations are each carried out only in a direction perpendicular to the main and sub scanning directions (vertical operations) Moreover, the maintenance mechanisms are separately arranged as the left- and right-hand portions at both ends outside the printing region. With this construction, it is possible to use effectively the space existing at each end of the printing region, which is inevitably created in a 2-pen type serial printer. Thus, in each of the maintenance regions L and R thus separately arranged, the flexibility in the arrangement of its maintenance mechanism is significantly enhanced, and thereby a sufficient volumetric capacity can be secured in the waste ink collecting bath 20*a* and 20*b*.

Hence, the widthwise size of the apparatus main body can be reduced to a minimum ("printer's minimum width", refer to FIG. 8) without imposing strict limitations on the other maintenance mechanisms (the capping and wiping mechanisms). In addition to that, the maintenance mechanisms arranged in the left-and right-hand maintenance regions L and R are driven concurrently by a single cam shaft 14 which is rotationally driven. In this case, only one driving source is required, and the number of constituent components can accordingly be reduced. Moreover, the construction can be controlled with ease, and resultantly the manufacturing cost can be reduced.

Next, with reference to the flow chart shown in FIG. 6, a description will be given below as to the operation and action of the maintenance mechanism under the cleaning operation mode. Note that, in the cleaning process for cleaning the ink nozzle portion, the wiping operation (for wiping and cleaning the nozzle surface of the printing head 3 and 4) and the spitting operation (for blowing off the residual ink deposited onto the nozzle surface by discharge of ink) are commonly paired up with each other.

Figure 6:
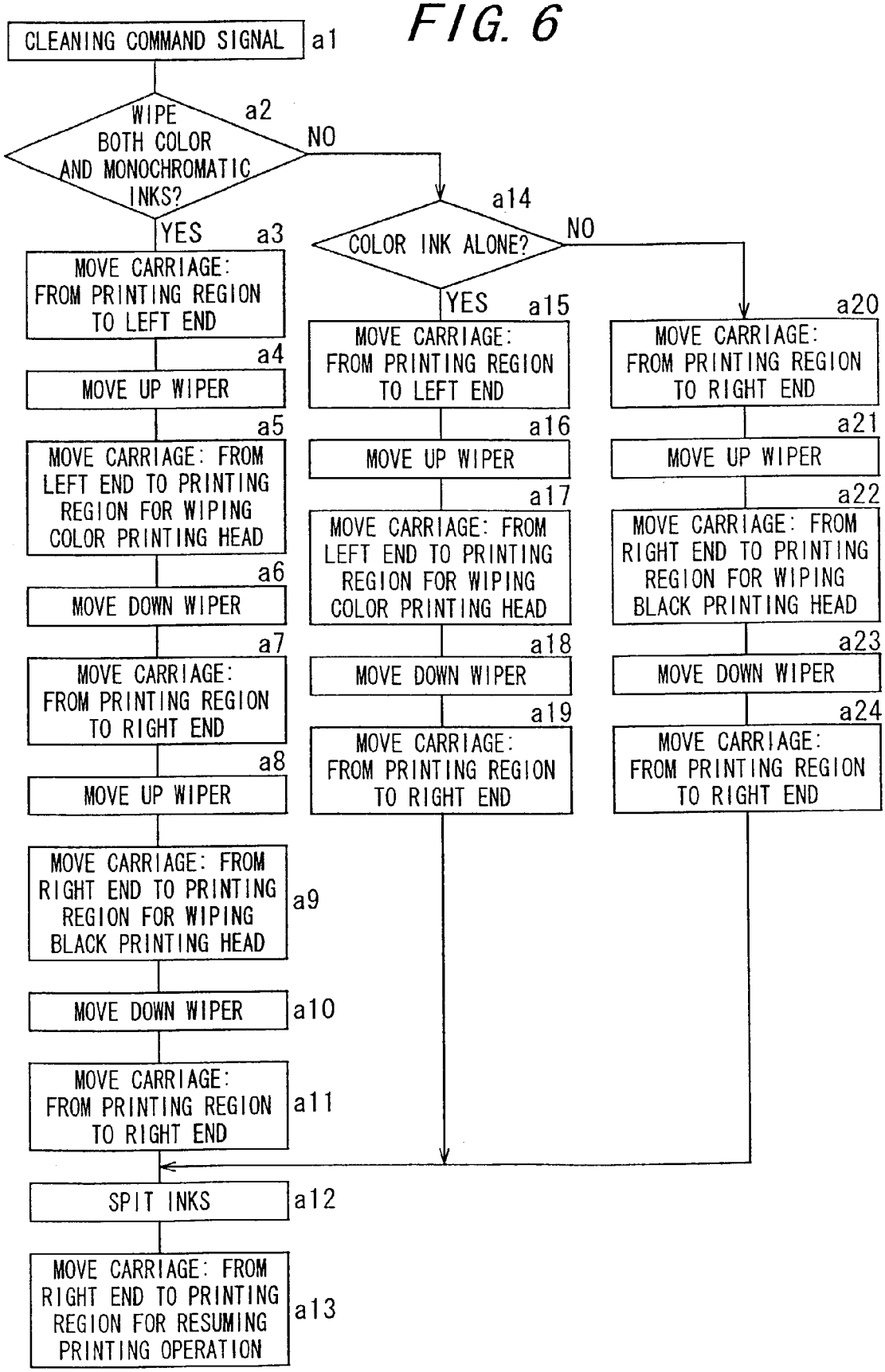
FIG. 6 is a flow chart for explaining the maintenance operation conducted in the printer.

In FIG. 6, the cleaning procedure is separated into three flows according to cleaning instructions given to each printing head. Firstly, a detailed operational flow on the cleaning of both of the color printing head 3 and the black printing head 4 will be described. The carriage 2 is moved from the printing region to the left-hand maintenance region L. Next, the wiper 7*c* for wiping and cleaning the color printing head 3 is moved upward by operating the cams.

Subsequently, the carriage 2 is moved from the left-hand maintenance region L to the printing region Wp. During this time, the wiper 8*c* is flexibly brought into abutment with the nozzle surface of the printing head 3, thereby carrying out the wiping operation. After the completion of the wiping operation, the wiper 8*c* is moved downward once. Thereafter, the carriage 2 is moved toward the right-hand maintenance region R.

Then, after the wiper 8*b* is moved upward, the carriage 2 is moved from the right end to the printing region Wp (left end). During this time, the wiper 8*b* is flexibly brought into abutment with the nozzle surface of the black printing head 4, thereby carrying out the wiping and cleaning operations. After that, the wiper 8*b* is moved downward.

Next, the carriage 2 is moved toward the right-hand maintenance region R once again. Then, the ink discharge operation (spitting operation) is carried out to remove the residual ink remaining around the nozzle of the printing head 3 and 4. The ink thus discharged is collected in the waste ink collecting baths 20*a* and 20*b* disposed in the maintenance region R. Note that the cleaning operation applied solely to the color printing, as well as the same operation applied solely to the black (monochromatic) printing, is carried out basically in the same manner as in the color/black printing.

More specifically, a cleaning command signal triggers the wiping operation in step al. If the control unit 22 determines in subsequent step a2 that the cleaning command indicates the wiping of both a color ink and a monochromatic ink, the control proceeds to step a3 where the carriage 2 is moved from the printing region Wp substantially of the same area as that of a sheet conveyance region shown in FIG. 1 to the one end along the main scanning movement defined as the left end of the main frame 1 so as to be positioned directly above the maintenance region L on one side. In subsequent step a4, the control unit 22 controllably drives the motor 20 to rotate the cam shaft 14 based on a number of feed steps and a signal from the cam switch 16, thereby bringing the second cams 14*b* and 14*d* into rotation to raise the wipers 8*c* and 8*b* to the wiping mode positions, relating to rotation of the second cams 14*b* and 14*d*.

In step a5, the carriage 2 at the left end is moved toward the printing region Wp along the main scanning direction, thereby performing the wiping of the color ink. Thus, the wiper 8*c* cleans by wiping the nozzle surface at the print head 3 for color ink. In subsequent step a6, the control unit 22 controllably drives the motor 20 to rotate the cam shaft 14 based on a number of feed steps and a signal from the cam switch 16, thereby bringing the second cams 14*b* and 14*d* into rotation to lower the wipers 8*c* and 8*b* to places out of interference with the print heads 3 and 4, relating to rotation of the second cams 14*b* and 14*d*. In subsequent step a7, the carriage 2 is moved from the printing region Wp to the other end of the main scanning movement defined as the right end of the main frame 1, so that the carriage 2 is positioned directly above the other maintenance region R.

In subsequent step a8, the control unit 22 controllably drives the motor 20 to rotate the cam shaft 14 based on a number of feed steps and a signal from the cam switch 16, thereby bringing the second cams 14*b* and 14*d* into rotation to raise the wipers 8*c* and 8*b* to the wiping mode positions, relating to rotation of the second cams 14*b* and 14*d*. In subsequent step a9, the carriage 2 at the right end is moved toward the printing region Wp along the main scanning direction, thereby performing the wiping of the monochromatic ink. Thus, the wiper 8*b* cleans by wiping the nozzle surface at the print head 4 for black ink. In subsequent step a10, the control unit 22 controllably drives the motor 20 to rotate the cam shaft 14 based on a number of feed steps and a signal from the cam switch 16, thereby bringing the second cams 14*b* and 14*d* into rotation to lower the wipers 8*c* and 8*b* relating to rotation of the second cams 14*b* and 14*d*, to places out of interference with the print heads 3 and 4. In subsequent step all, the carriage 2 is moved from the printing region Wp to the right end of the main frame 1, so that the carriage 2 is positioned directly above the other maintenance region R.

In subsequent step a12, the print heads 3 and 4 perform the purging cleaning by individually spitting the inks toward the waste ink collecting bath 20*a* and 20*b* of the maintenance region R. In subsequent step a13, the carriage 2 at the right end is moved to the printing region Wp along the main scanning direction, so that the printing operation is resumed.

If the control unit 22 determines in step a2 that the cleaning command does not indicate the wiping of both the color ink and the monochromatic ink and then determines in step a14 that the cleaning command indicate the wiping of the color ink, the same operations as in above-mentioned steps a3 to a7 are performed in steps a15 to a19 for cleaning by wiping the nozzle surface at the print head 3 for color ink. After the purging cleaning is performed in subsequent step a12, the printing operation is resumed in step a13.

If the control unit 22 determines in step a2 that the cleaning command does not indicate the wiping of both the color ink and the monochromatic ink and then determines in step a14 that the cleaning command indicates the wiping of the monochromatic ink rather than the color ink, the same operations as in above-mentioned steps a7 to all are performed in steps a20 to a24 for cleaning by wiping the nozzle surface at the print head 4 for monochromatic ink. After the purging cleaning is performed in subsequent step a12, the printing operation is resumed in step a13.

Figure 7:
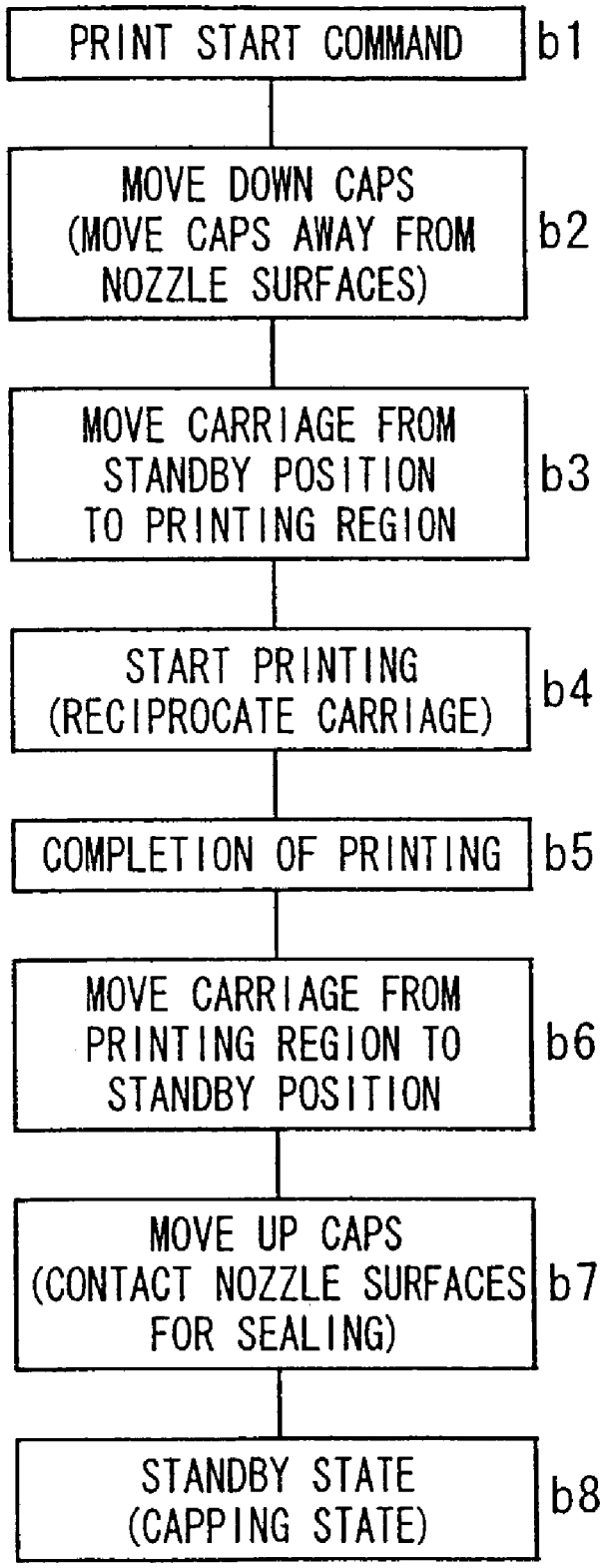
FIG. 7 is a flowchart for explaining the operation in a capping operation mode.

FIG. 7 is the flowchart for explaining the operation in the capping operation mode. In response to a print start command given in step b1, step b2 is performed where the control unit 22 controllably drives the motor 20 to rotate the cam shaft 14 based on a number of feed steps and a signal from the cam switch 16, thereby bringing the first cams 14*a* and 14*c* into rotation to lower the caps 7*c* and 7*b* from the capping mode positions to the printing mode positions, relating to rotation of the first cams 14*a* and 14*c*. Thus, the caps 7*c* and 7*b* are moved away from the nozzle surfaces at the print heads 3 and 4. In subsequent step b3, the carriage 2 at the standby position is moved to the printing region Wp. In step b4, the printing operation is started while the carriage 2 reciprocates along the main scanning direction.

At termination of the printing operation in step b5, the carriage 2 at the printing region Wp is moved to the standby position in step b6. In step b7, the control unit 22 controllably drives the motor 20 to rotate the cam shaft 14 based on a number of feed steps and a signal from the cam switch 16, thereby bringing the first cams 14*a*, 14*c* into rotation to raise the caps 7*c* and 7*b* from the printing mode positions, relating to rotation of the first cams 14*a* and 14*c* to the capping mode positions. Thus, the caps 7*c* and 7*b* come into intimate contact with the nozzle surfaces at the print heads 3 and 4 for sealing the nozzle surfaces. In subsequent step b8, the print heads stay at the standby positions to maintain a capped state until the next print start command is given.

In this embodiment, as described hereinabove, by dividing the maintenance mechanism for performing the foregoing maintenance operations into the left- and right-hand maintenance regions L and R, the widthwise size of the apparatus main body can be reduced to a minimum. Now, for further clarification and understanding on the configuration, the "printer's minimum width" mentioned previously will be explained below with reference to FIG. 8.

Figure 8:
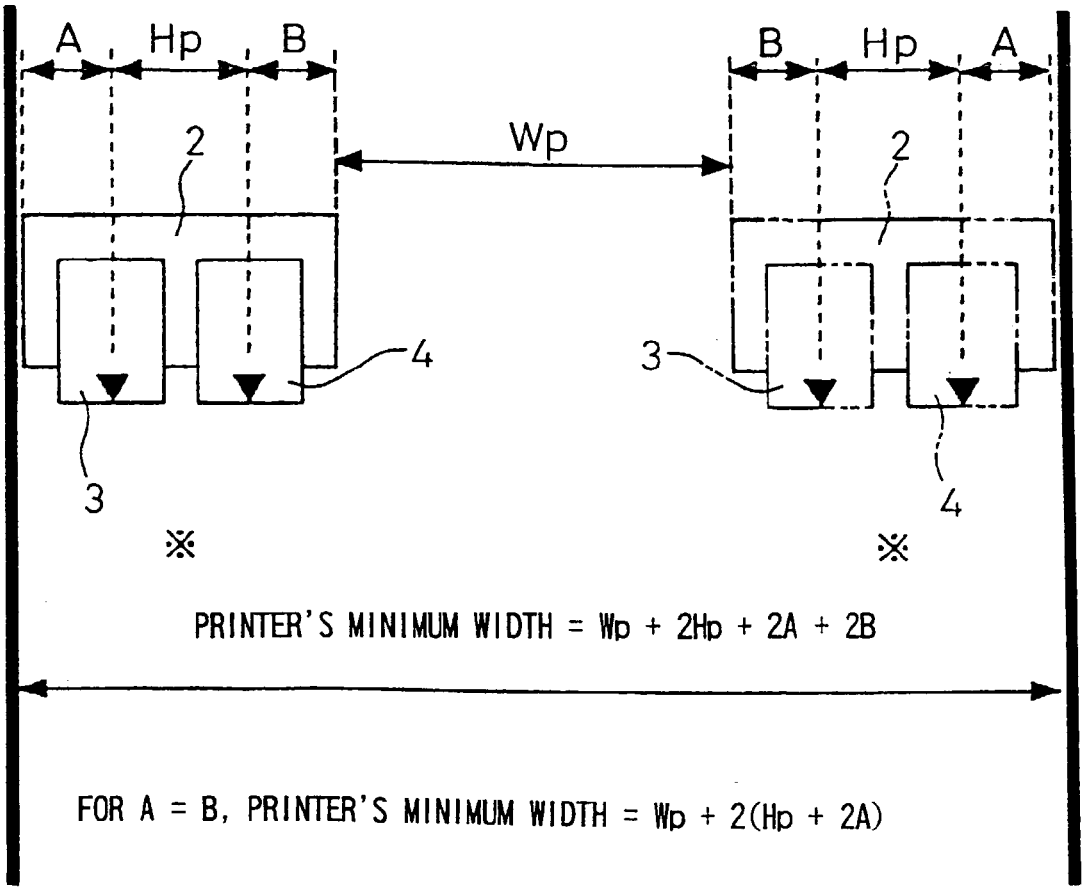
FIG. 8 is a view for explaining the minimum width of the printer.
Figure 9:
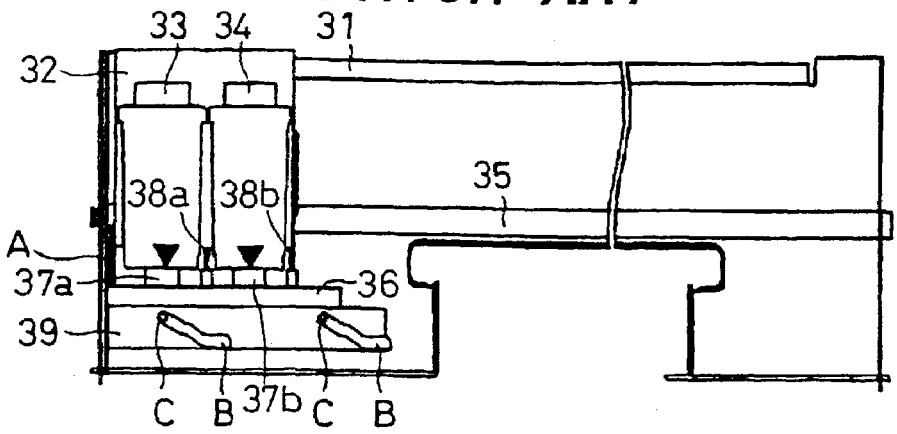
FIG. 9 PRIOR ART
FIG. 9 is a block diagram of a conventional printer being operated in a capping operation mode.
Figure 10:
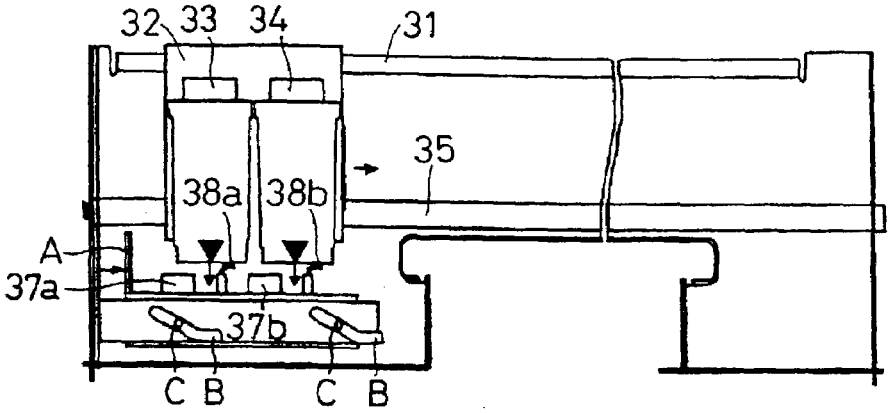
FIG. 10 PRIOR ART
FIG. 10 is a block diagram of the conventional printer being operated in a wiping operation mode.
Figure 11:
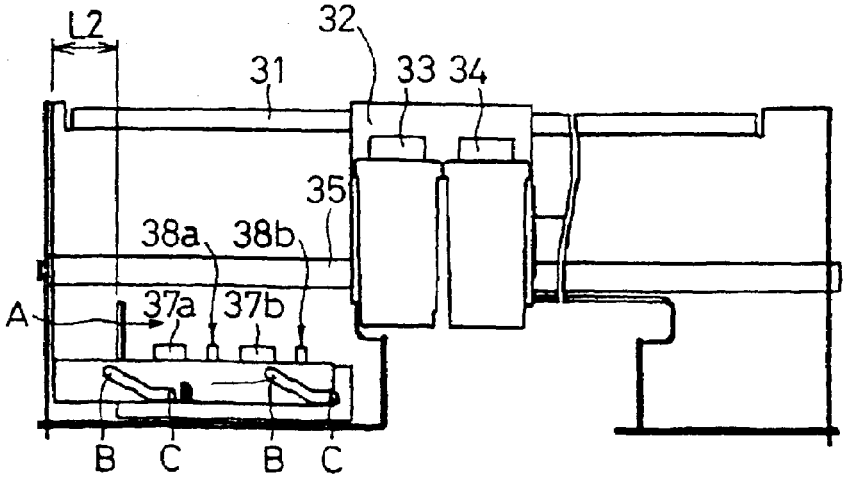
FIG. 11 PRIOR ART
FIG. 11 is a block diagram of the conventional printer being operated in a printing operation mode.

As is widely known, in the so-called 2-pen type serial printer, as seen from FIG. 8, an interval (pitch) Hp is secured between the two nozzles (printing elements) of the printing heads 3 and 4, and an interval A, B is secured between the printing element and the contour portion of the printing head 3 and 4. In this case, to accomplish the effective permissible printing width Wp, it is necessary to prepare a driving system mechanism whose width is given at least as Wp+2Hp+2A+2B.

Such a driving system mechanism is obviously necessitated in the serial printer that produces a printed record by reciprocating two printing heads 3 and 4 along the main scanning direction and by conveying a printing medium along the sub scanning direction. If the width of the driving system mechanism is less than the above level, it is impossible to reduce the widthwise dimension of the apparatus main body. That is, the width (Wp+2Hp+2A+2B) of the driving system mechanism is defined as the "minimum necessary width for the printer".

In this embodiment, as described above, the maintenance stations are provided at the left- and right-hand portions, and they are arranged in the space existing at both ends outside the printing region (indicated by symbol ·X· in FIG. 8). That is, the space indicated by ·X· is utilized as the left- and right-hand maintenance regions L and R. Moreover, the maintenance mechanism is so designed that the capping and wiping operations are each carried out only in a direction perpendicular to the main and sub scanning directions (vertical operations). Hence, in this construction, no conventional operation is carried out in a horizontal direction (main scanning direction for printing), and this does away with the need for securing extra space in the horizontal direction. As a result, the widthwise size (the size as viewed in the main scanning direction) of the apparatus main body can be reduced to a minimum, i.e. to the "printer's minimum width".

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A printer in which printing is carried out by reciprocating a carriage carrying two printing heads along a main scanning direction, comprising:

maintenance mechanisms each including a wiper for wiping a nozzle of the printing head in a part of a range of reciprocation of the carriage, the wipers are respectively arranged at both ends of the range of reciprocation of the carriage, the ends being outside a printing region, wherein, the maintenance mechanisms, which are respectively arranged at the both ends of the range of reciprocation of the carriage, are driven by a cam attached to a single cam shaft, and the cam shaft is rotationally driven, wherein the maintenance mechanism includes, a cap for sealing the nozzle;

a cap for holding member for holding the cap;

a cam;

a cam shaft to which the cam is attached; and a pair of first urging means for urging the cap holding member into abutment with the cam, wherein, the pair of first urging means are arranged at places on one of the diagonal lines of the cap holding member as equally-spaced on both sides of the cam shaft.

2. The printer of claim 1, wherein the maintenance mechanism comprises:

a cap for sealing the nozzle;

a first cam for acting to move the cap retractably and advanceably with respect to the printing head;

a second cam for acting to move the wiper retractably and advanceably with respect to the printing head; and a single cam shaft to which the first and second cams are attached, and wherein switching among the following three modes is made by rotating the cam shaft one turn:

a capping mode for sealing the nozzle by the cap;

a wiping mode for wiping the nozzle by the wiper; and an ordinary printing mode.

3. The printer of claim 1, wherein the maintenance mechanism comprises:

a wiper holding member for holding the wiper;

a cam; and a cam shaft to which the cam is attached, wherein the pair of tensile springs urge the wiper holding member into abutment with the cam, and the pair of tensile springs are arranged at places on opposite sides of the cam shaft as equally-spaced from an axis of the wiper holding member orthogonal to the cam shaft.

4. The printer of claim 3, wherein the second urging means is constituted by a tensile spring.

5. The printer of claim 1, wherein the first urging means is constituted by a tensile spring.

6. A printer in which printing is carried out by reciprocating a carriage carrying two printing heads along a main scanning direction, comprising:

maintenance mechanisms each including a wiper for wiping a nozzle of the printing head in a part of a range of reciprocation of the carriage, the wipers are respectively arranged at both ends of the range of reciprocation of the carriage, the ends being outside a printing region, and wherein, the maintenance mechanisms are so operated as to move only in a direction perpendicular to the main scanning direction and a sub scanning direction.

7. The printer of claim 6, wherein the maintenance mechanism comprises:

a cap for sealing the nozzle;

a first cam for acting to move the cap retractably and advanceably with respect to the printing head;

a second cam for acting to move the wiper retractably and advanceably with respect to the printing head; and a single cam shaft to which the first and second cams are attached, and wherein switching among the following three modes is made by rotating the cam shaft one turn:

a capping mode for sealing the nozzle by the cap;

a wiping mode for wiping the nozzle by the wiper; and an ordinary printing mode.

8. The printer of claim 6, wherein the maintenance mechanism comprises:

a cap for sealing the nozzle;

a cap for holding member for holding the cap;

a cam;

a cam shaft to which the cam is attached; and a pair of first urging means for urging the cap holding member into abutment with the cam, the pair of first urging means being arranged at places on one of the diagonal lines of the cap holding member as equally-spaced on both sides of the cam shaft.

9. The printer of claim 8, wherein the first urging means is constituted by a tensile spring.

10. The printer of claim 6, wherein the maintenance mechanism comprises:

a wiper holding member for holding the wiper;

a cam;

a cam shaft to which the cam is attached; and a pair of second urging means for urging the wiper holding member into abutment with the cam, the pair of second urging means being arranged at places on opposite sides of the cam shaft as equally-spaced from an axis of the wiper holding member orthogonal to the cam shaft.

11. The printer of claim 10, wherein the second urging means is constituted by a tensile spring.

12. The printer of claim 6 wherein the maintenance mechanism comprises a cap for sealing the nozzle, and a waste ink collecting bath for collecting ink discharged from the nozzle, and wherein in one end of the range of reciprocation of the carriage, the cap, the wiper and the cap are provided along the main scanning direction in this order, whereas in the other end of the range of reciprocation of the carriage, the waste ink collecting bath, the wiper and the waste ink collecting bath are provided along the main scanning direction in this order.

13. A printer in which printing is carried out by reciprocating a carriage carrying two printing heads along a main scanning direction, comprising:

maintenance mechanisms each including a wiper for wiping a nozzle of the printing head in a part of a range of reciprocation of the carriage, the wipers are respectively arranged at both ends of the range of reciprocation of the carriage, the ends being outside a printing region, wherein the maintenance mechanism comprises a cap for sealing the nozzle, and a waste ink collecting bath for collecting ink discharged from the nozzle, and wherein in one end of the range of reciprocation of the carriage, the cap, the wiper and the cap are provided along the main scanning direction in this order, whereas in the other end of the range of reciprocation of the carriage, the waste ink collecting bath, the wiper and the waste ink collecting bath are provided along the main scanning direction in this order.

* * * * *